US008454323B2

(12) United States Patent
Schmidt et al.

(10) Patent No.: US 8,454,323 B2
(45) Date of Patent: Jun. 4, 2013

(54) LUBRICANT VALVE FOR OIL PUMPS OF INTERNAL COMBUSTION ENGINES

(75) Inventors: Eugen Schmidt, Merbelsrod/Thueringen (DE); Andreas Schmidt, legal representative, Schwarzbach (DE); Toni Steiner, Bachfeld (DE)

(73) Assignee: Geraete- und Pumpenbau GmbH Dr. Eugen Schmidt, Merbelsrod/Thueringen (DE)

( * ) Notice: Subject to any disclaimer, the term of this patent is extended or adjusted under 35 U.S.C. 154(b) by 0 days.

(21) Appl. No.: 13/640,446

(22) PCT Filed: Apr. 20, 2011

(86) PCT No.: PCT/DE2011/000426

§ 371 (c)(1),
(2), (4) Date: Oct. 10, 2012

(87) PCT Pub. No.: WO2011/137890

PCT Pub. Date: Nov. 10, 2011

(65) Prior Publication Data

US 2013/0081720 A1 Apr. 4, 2013

(30) Foreign Application Priority Data

May 3, 2010 (DE) ..... 10 2010 019 044

(51) Int. Cl.
*F04B 49/22* (2006.01)
*F01M 1/02* (2006.01)

(52) U.S. Cl.
USPC ..... 417/228; 417/307; 123/196 R

(58) Field of Classification Search
USPC ..... 417/228, 307, 364; 137/494, 599.18; 123/196 R; 184/6.4
See application file for complete search history.

(56) References Cited

U.S. PATENT DOCUMENTS

| | | | | |
|---|---|---|---|---|
| 2,298,646 | A * | 10/1942 | Ovens | 184/6.4 |
| 4,412,789 | A | 11/1983 | Ohe et al. | |
| 5,797,732 | A * | 8/1998 | Watanabe et al. | 417/310 |
| 6,082,321 | A * | 7/2000 | Kopec | 123/196 R |
| 6,161,515 | A * | 12/2000 | Kopec | 123/196 R |
| 6,186,750 | B1 * | 2/2001 | Hunter | 417/307 |
| 7,011,069 | B2 | 3/2006 | Ono et al. | |
| 8,297,307 | B2 * | 10/2012 | Kurokawa et al. | 137/538 |

FOREIGN PATENT DOCUMENTS

| | | |
|---|---|---|
| DE | 31 42 604 | 8/1982 |
| DE | 100 15 971 | 11/2000 |
| DE | 19956929 A1 * | 5/2001 |

(Continued)

*Primary Examiner* — Devon Kramer
*Assistant Examiner* — Nathan Zollinger
(74) *Attorney, Agent, or Firm* — Collard & Roe, P.C.

(57) ABSTRACT

A lubricant valve for oil pumps of internal combustion engines has a double piston in a piston guide of a valve seat of the pump housing, the double piston consisting of a cold-start piston which is arranged in a control piston and is arranged in a cold-start piston guide which is arranged in the control piston, wherein, lying opposite the cold-start piston guide, a piston rod is arranged on the piston head of the control piston, on which piston rod, spaced apart from the piston head of the control piston, a working piston is arranged which the piston rod protrudes beyond in the form of a spacer rod, wherein, adjacent to the working piston, inflow holes are arranged in the piston head of the control piston and, adjacent to the piston head, outflow holes are arranged in the cylinder wall of the cold-start piston guide of the control piston.

9 Claims, 5 Drawing Sheets

FOREIGN PATENT DOCUMENTS

Figure 1:
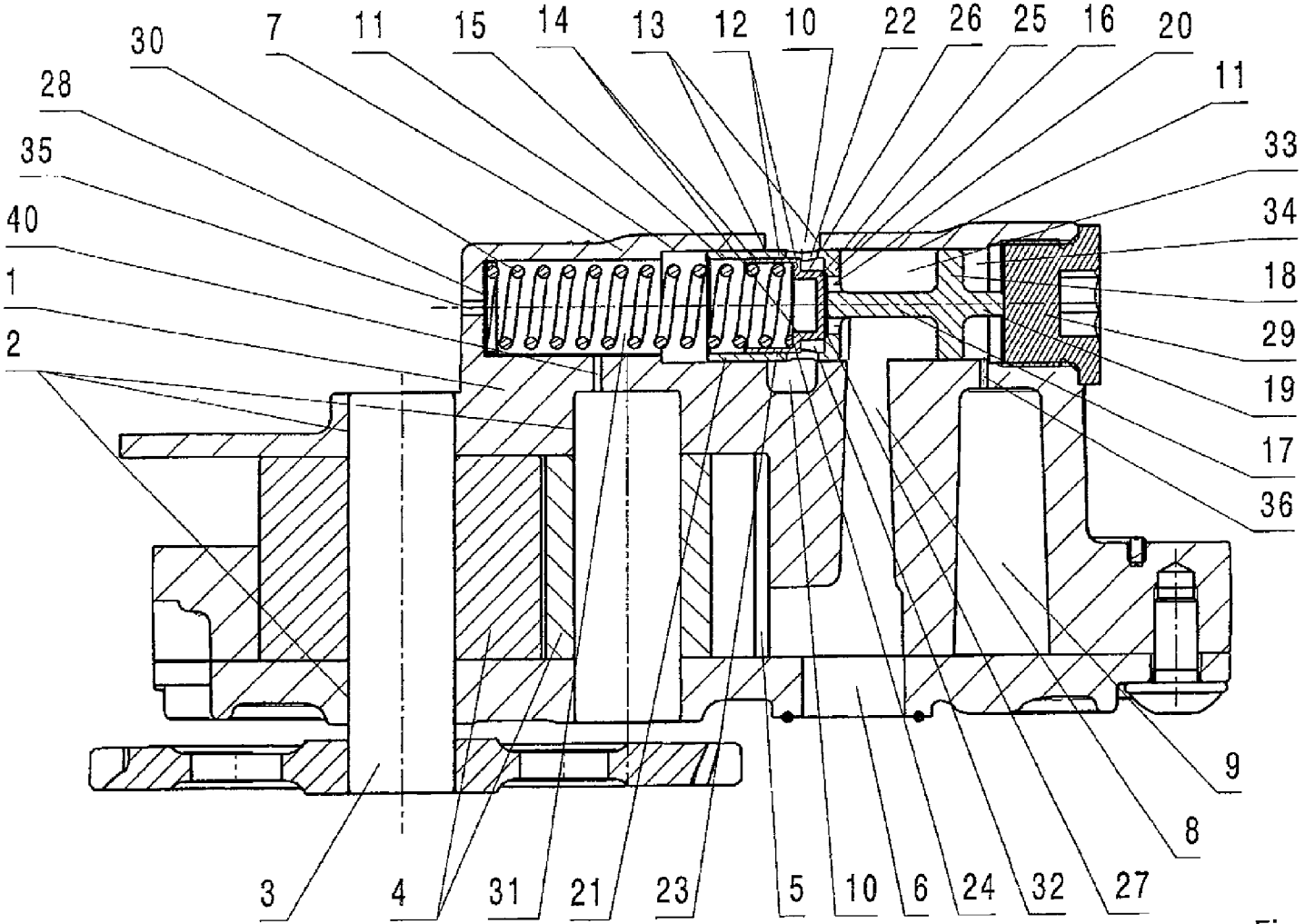

| | | |
|---|---|---|
| DE | 202 15 258 | 3/2004 |
| DE | 10 2007 058 759 | 9/2008 |
| DE | 60 2004 010 989 | 12/2008 |
| EP | 1 529 958 | 5/2005 |

* cited by examiner

LUBRICANT VALVE FOR OIL PUMPS OF INTERNAL COMBUSTION ENGINES

CROSS REFERENCE TO RELATED APPLICATIONS

This application is the National Stage of PCT/DE2011/000426 filed on Apr. 20, 2011, which claims priority under 35 U.S.C. §119 of German Application No. 10 2010 019 044.6 filed on May 3, 2010, the disclosure of which is incorporated by reference. The international application under PCT article 21(2) was not published in English.

The invention relates to a lubricant valve for oil pumps of internal combustion engines, in order to optimally supply the bearings and sliding surfaces of the engines with lubricant, in order to reduce wear.

In the practice of engine construction, particularly for motor vehicles, the most varied lubricant valves are known.

In order to avoid pressure peaks during the startup phase of the engine and to minimize wear of the engine, valves are disposed in the lubricant circuit, behind the oil pump in the flow direction of the lubricant, which valves open during the startup phase of the engine, as cold-start valves, because cold lubricant oil has a high viscosity, and avoid pressure peaks until the lubricant oil has warmed up to such an extent that its viscosity guarantees regulation by way of a further regulation valve disposed in the oil circulation.

This regulation valve is required to guarantee optimal lubricant oil pressure during ongoing operation of internal combustion engines, along with the cold-start valve, because the oil pumps used to supply lubricant to internal combustion engines, for example gerotor pumps or gear-wheel pumps, generate an increasing lubricant volume stream with an increasing engine speed of rotation, i.e. convey more lubricant than is required for lubrication of the bearings and sliding surfaces of the engine, in each instance. For this reason, the pump dispensing pressure would also increase with an increasing speed of rotation.

The regulation valve disposed in the oil circulation of internal combustion engines now serves to guarantee an almost uniform lubricant oil pressure in the gallery.

Pressure-limiting valves for the lubricant circulation of internal combustion engines are known from DE 10 2007 058 759 A1, as well as from DE 202 15 258 U1.

The disadvantage of these pressure-limiting valves, which are disposed separately in the engine block, in each instance, consists, on the one hand, in the great production effort for manufacturing of these pressure-limiting valves, and, on the other hand, in the great assembly effort for installation of these valves.

In the state of the art, a regulation valve is furthermore previously described, for example in EP 1 529 958 B1 and DE 60 2004 010 989 T2, respectively.

This regulation valve, previously described there, has a complicated structure, in terms of production and assembly, and a complicated component geometry. As a result of the regulation bore, which is interrupted multiple times, this design is very sensitive to dirt, so that friction-wear particles or mold sand carried by the lubricant can easily embed themselves in the regulation valve, and, under disadvantageous general conditions, can lead to jamming of the valve piston, and thus to total failure of the regulation.

In this connection, the present solution is suitable only for small through-flow quantities, because of the relatively small gap geometries.

The regulation valve presented in EP 1 529 958 B1 furthermore cannot be used as a cold-start valve.

Other designs of regulation valves are known from DE 31 42 604 A1, as well as from U.S. Pat. No. 6,186,750 (DE 100 15 971 A1). These designs for pump units, having two pump stages, necessarily require a second pump, and are therefore unsuitable for conventional low-pressure oil pumps.

Aside from the increased costs that result from a second pump stage, both of the aforementioned solutions, i.e. the solution presented in DE 31 42 604 A1 and the one presented in U.S. Pat. No. 6,186,750 B1 and DE 100 15 971 A1, respectively, once again have complicated component geometries, furthermore require an additional safety valve, and just like the solution presented in EP 1 529 958 B1, are very sensitive to dirt, because the regulation bores provided in DE 3142604 A1 as well as the one in U.S. Pat. No. 6,186,750 B1 are interrupted multiple times, because of their function, so that in these solutions, too, the friction-wear particles and/or mold sand carried by the lubricant can easily embed themselves, and, under disadvantageous general conditions, can lead to jamming of the valve piston, and thus to total failure of the regulation.

Once again, the regulation valves presented in DE 31 42 604 A1 and in U.S. Pat. No. 6,186,750 B1 also cannot be used as cold-start valves.

The invention is therefore based on the task of developing a lubricant valve for oil pumps of internal combustion engines, which eliminates the aforementioned disadvantages of the state of the art, particularly combines the functions of a cold-start valve and those of a regulation valve in itself, with minimal construction space, while having such a structure that it is not sensitive to friction-wear particles and/or mold sand carried by the lubricant, while allowing great through-flow quantities, and has a cost-advantageous structure, in terms of production and assembly technology, and can be produced cost-advantageously, and furthermore always works in robust, reliable, and non-failure-prone manner, even under extreme conditions of use.

According to the invention, this task is accomplished by a lubricant valve for oil pumps of internal combustion engines having the characteristics of the main claim of the invention.

Advantageous embodiments, details, as well as further characteristics of the invention are evident from the dependent claims as well as from the following description of the exemplary embodiment according to the invention, in connection with the drawings relating to the solution according to the invention.

In the following, the invention will now be explained in greater detail using an exemplary embodiment, in connection with five drawing representations.

Figure 2:
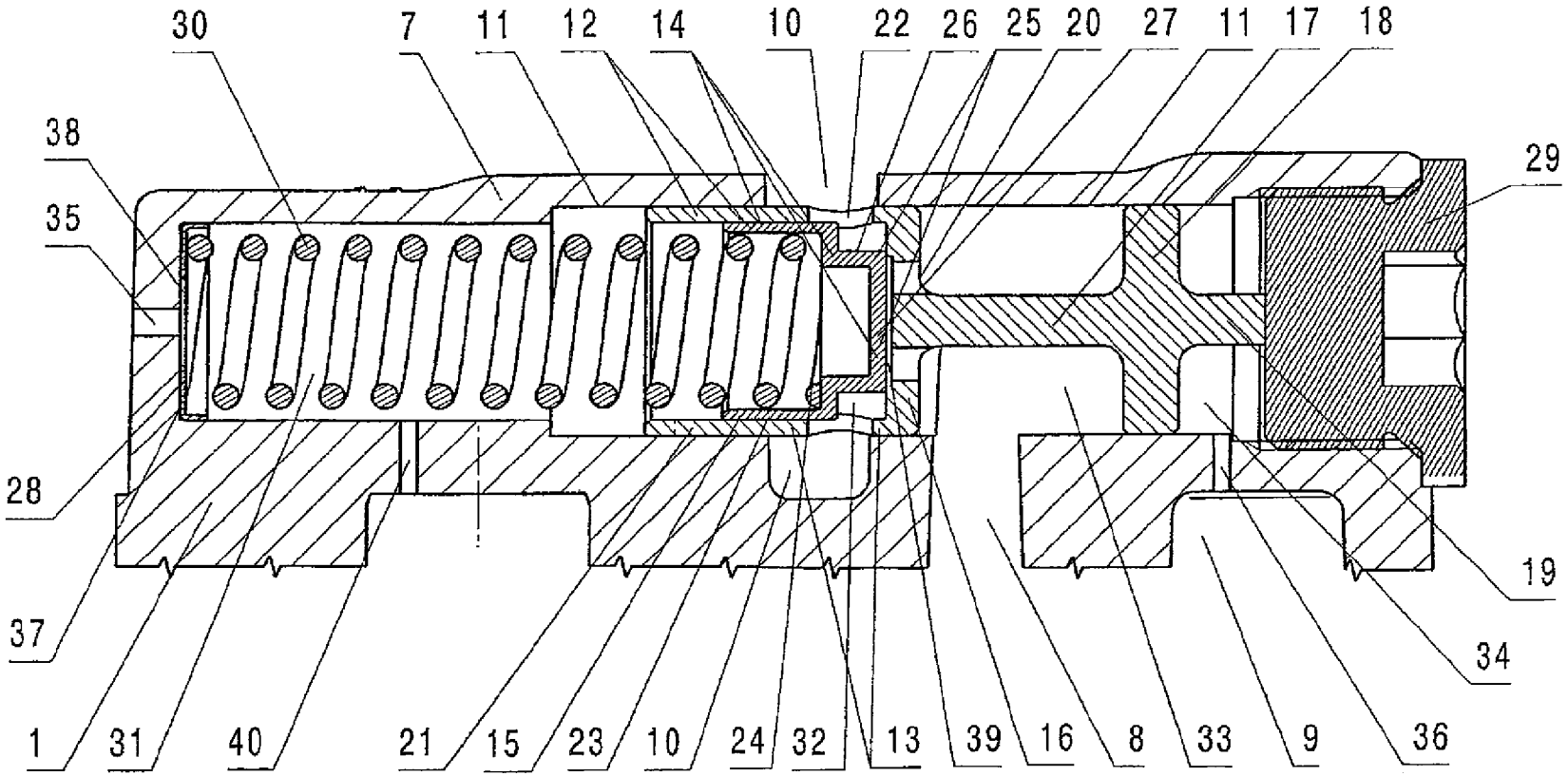
Figure 3:
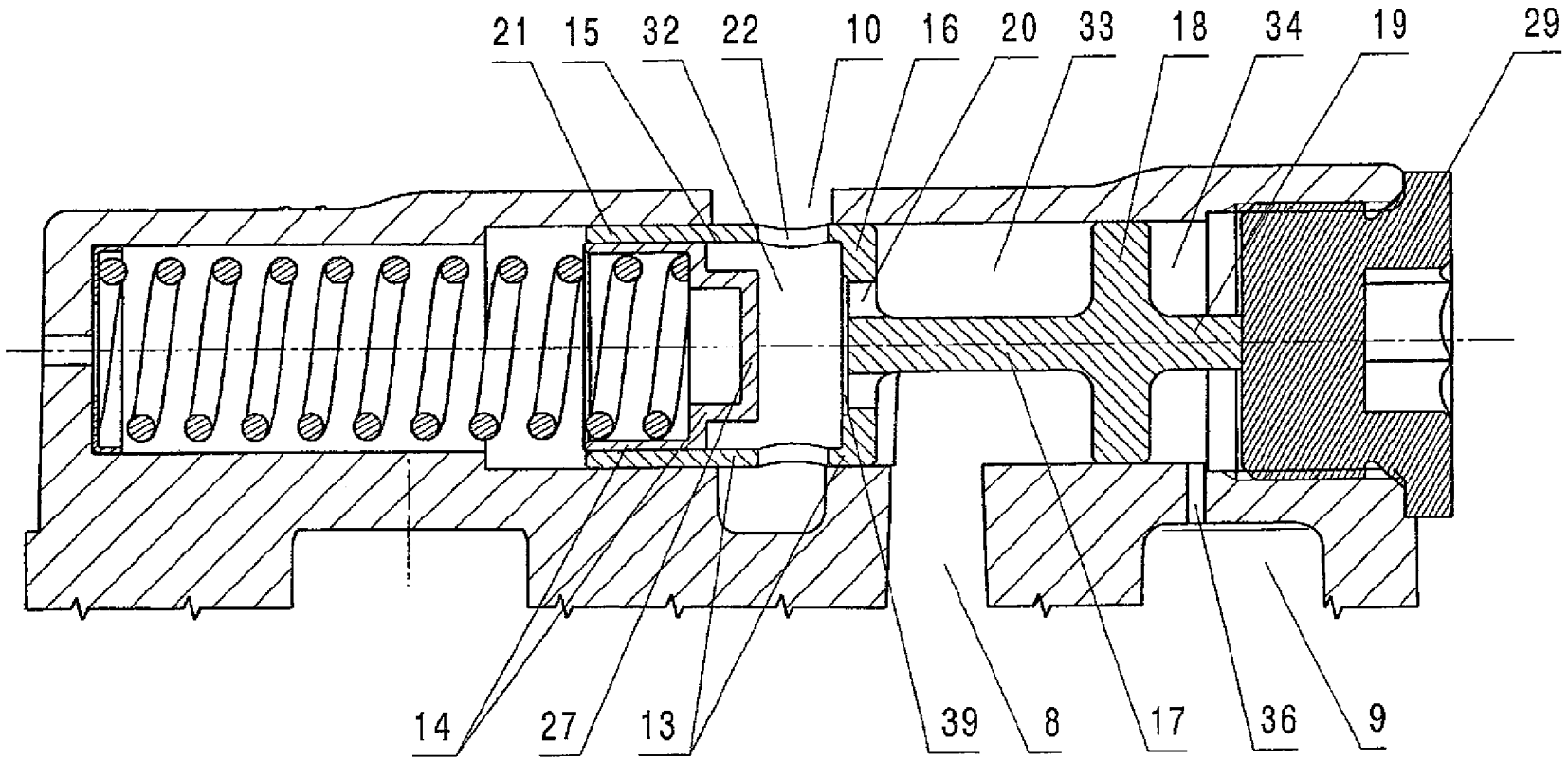
Figure 4:
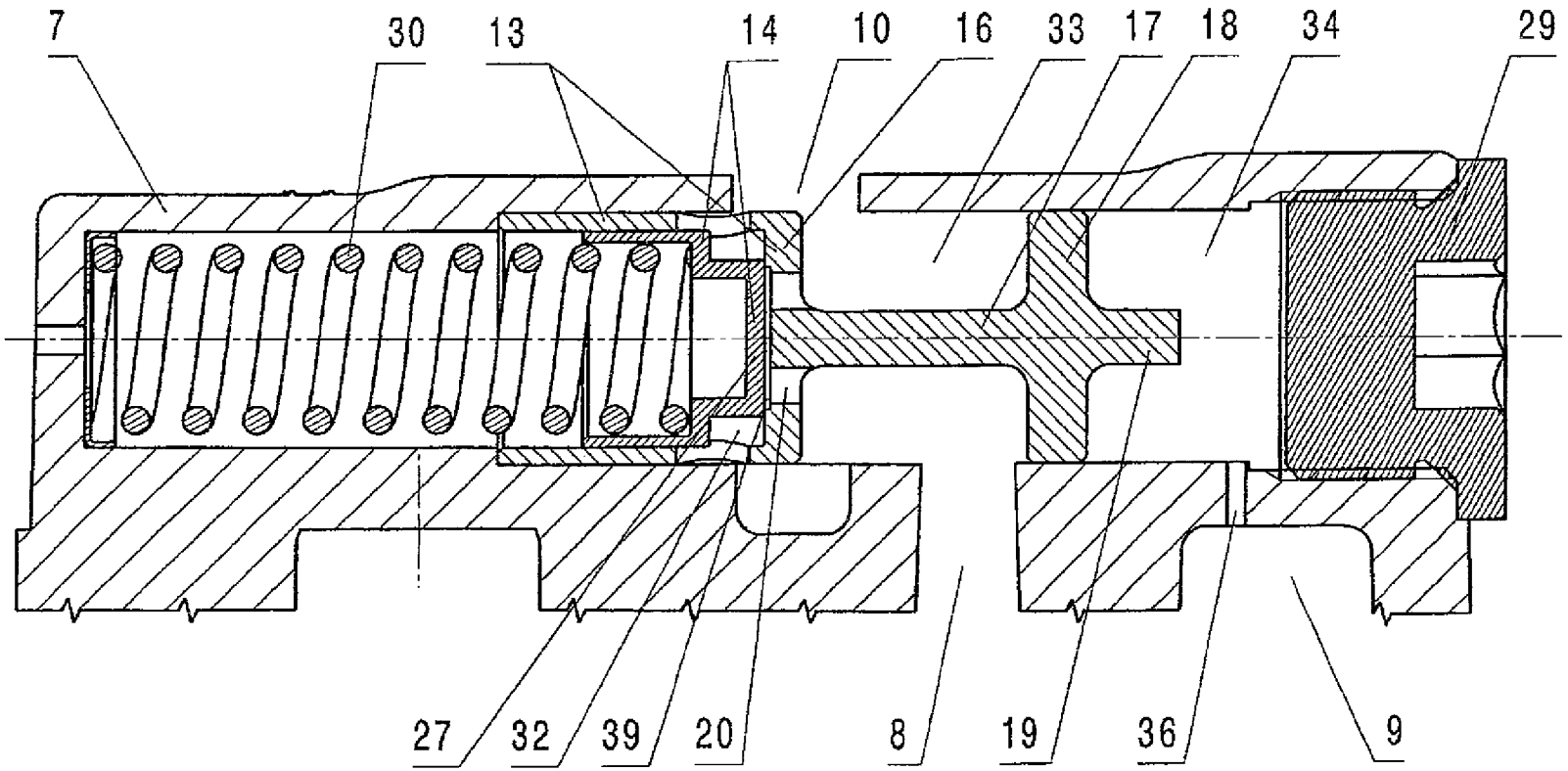
Figure 5:
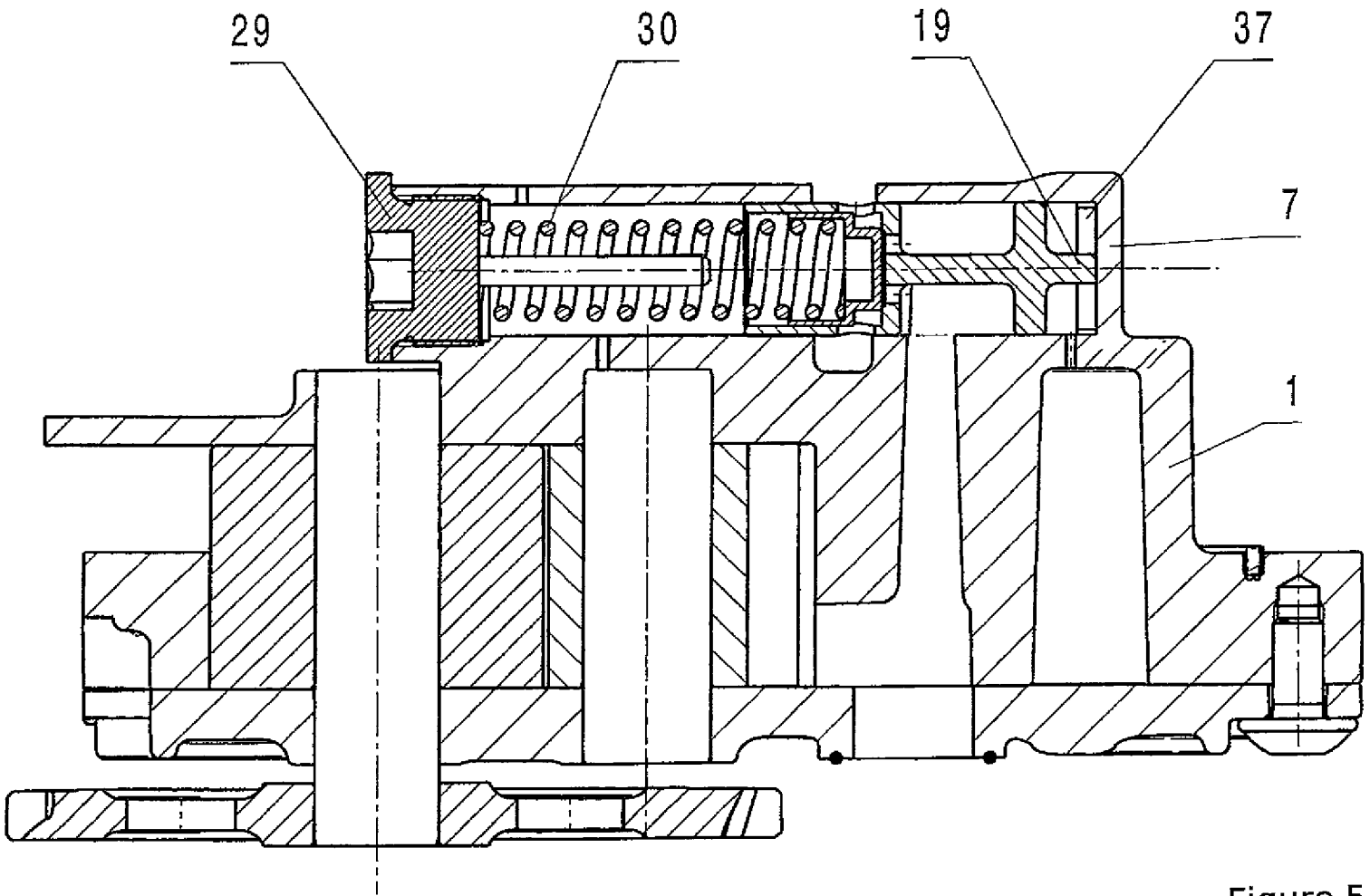

In this connection, these show:

FIG. 1: a section through a possible design of an oil pump for internal combustion engines, with the lubricant valve integrated into the pump housing, according to the invention, with the engine stopped;

FIG. 2: the lubricant valve shown in FIG. 1, with the engine stopped, in an enlarged representation;

FIG. 3: the lubricant valve shown in FIG. 1, in its regulation function, during a cold start;

FIG. 4: the lubricant valve shown in FIG. 1, in its regulation function, with the engine running warm, in ongoing operation;

FIG. 5: the design of an oil pump for internal combustion engines shown in FIG. 1, with the lubricant valve integrated into the pump housing, according to the invention, with the engine stopped, in a somewhat modified design.

The pump housing 1 shown in FIG. 1, with bearing points 2, an impeller set 4 of a gear-wheel pump driven by a drive shaft 3 mounted in bearing points 2 (of course, analogously, this could also be the impeller set of a different oil pump design, for example that of a gerotor pump), with (a) pressure kidney(s) 5 disposed in the pressure region of the pump housing 1, with a pressure connection channel 6 disposed on the pump housing 1, with a valve seat 7 disposed on the pump housing 1, a pressure channel 8 disposed between the valve seat 7 and the pressure connection channel 6, a control channel 9 disposed between the valve seat 7 and the gallery, and an overflow channel 10 disposed between the valve seat 7 and the oil pan, with a double piston 12 disposed in a piston guide 11 of the valve seat 7 in the pump housing 1, with an outer regulation piston 13, in which an inner piston guide for an inner piston is disposed, whereby a piston rod 17 with at least one working piston 18 is disposed on the regulation piston, beyond which the piston rod 17 projects in the form of a spacer rod 19, whereby inflow bores 20 are disposed in the piston crown 16 of the regulation piston 13, and outflow bores 22 are disposed in the region of the inner piston guide in the cylinder wall 21 of the regulation piston 13.

A double piston 12, in a piston guide 11 of the valve seat 7 in the pump housing 1, consisting of a cold-start piston 14 disposed in a regulation piston 13, which is guided to be linearly displaceable in a cold-start piston guide 15 disposed in the regulation piston 13, is in accordance with the invention, as shown in FIGS. 1 and 2.

It is essential to the invention, in this connection, that the inner piston guide disposed in the regulation piston 13, the cold-start piston guide 15, in which a cold-start piston 14 is disposed as an inner piston, whereby the piston rod 17 is disposed lying opposite the cold-start piston guide 15, on the piston crown 16 of the regulation piston 13, on which rod a separate working piston 18 is disposed, at a distance from the piston crown 16 of the regulation piston 13, beyond which the piston rod 17 projects in the form of a spacer rod 19.

It is also characteristic that the inflow bores 20 are disposed in the piston crown 16 of the regulation piston 13, adjacent to the working piston 18, and the outflow bores 22 are disposed in the cylinder wall 21 of the cold-start piston guide 15 of the regulation piston 13, adjacent to the piston crown 16.

It is furthermore essential to the invention that the cold-start piston 14 is configured as a multi-stage cylinder piston open on one side, which consists of an open guide cylinder 23 disposed to be displaceable in the cold-start piston guide 15 of the regulation piston 13, with a spring contact ring surface 24 and a closing cylinder 25 disposed adjacent to the spring contact ring surface 24, smaller in cylinder diameter as compared with the guide cylinder 23, which cylinder is disposed on the spring contact ring surface 24 with its closing cylinder mantle 26 and has a closing cylinder lid 27 that closes off the inflow bores 20 when the closing cylinder lid 27 makes contact with the piston crown 16.

It is in accordance with the invention, in this connection, that a biased pressure spring 30, disposed between a spring contact 28 on the pump housing 1 and the spring contact ring surface 24 disposed in the guide cylinder 23 of the cold-start piston 14, presses the cold-start piston 14 into the regulation piston 13, sealing off the inflow bores 20, when the engine is stopped, and in this connection displaces the regulation piston 13 with the piston rod 17 disposed on it with the working piston 18 and the spacer rod 19 to such an extent until the free end of the spacer rod 19, opposite the spring contact 28, lies against an assembly and closure screw 29 disposed in the pump housing 1, and in this connection divides up the working space disposed in the valve seat 7, into a valve spring chamber 31, a cold-start chamber 32 disposed between the regulation piston 13 and the cold-start piston 14, a working chamber 33 disposed between the piston crown 16 of the regulation piston 13 and the working piston 18, in the region of the piston rod 17, as well as a control chamber 34 disposed behind the working piston 18, in the region of the spacer rod.

The arrangement, according to the invention, of a cold-start piston 14 pressed into the regulation piston 13 by means of a biased pressure spring 30, sealing off the inflow bores 20 in the regulation piston 13, is preferably also characterized in that not only the regulation piston 13 but also the cold-start piston 14 are produced from the same material, for example from steel.

These pistons, produced from the same material, for example from steel, the regulation piston 13 and the cold-start piston 14, now bring about the result, within the scope of their function according to the invention, their interaction as a double piston 12, that the minimal working gaps required between the two pistons always remain the same, even in the case of temperature expansions, thereby making it possible to guarantee minimized gap leakage in the entire working range.

In this connection, the structure according to the invention simultaneously makes it possible that the double piston 12, together with the pressure spring 30, can be separately pre-produced, and can also be separately checked with regard to its cold-start function reliability, even before installation.

Furthermore, it is characterizing that when the engine is stopped, the valve spring chamber 31 is connected with the oil pan by way of a damping bore 35, the working chamber 33 is connected with the pressure kidney 5 by way of the pressure channel 8, and the control chamber 34 is connected with the control channel 9 by way of a control bore 36.

With this solution according to the invention, it has been made possible to develop a lubricant valve for oil pumps of internal combustion engines that combines the functions of the cold-start valve and those of the regulation valve in itself, with minimal construction space, while being structured in such a manner that it is not sensitive to friction-wear particles and/or mold sand carried by the lubricant.

At the same time, the solution according to the invention, because of the large flow cross-sections disposed in the lubricant valve according to the invention, also allows high through-flow quantities.

Furthermore, the arrangement according to the invention, of only a few, compact, easy to produce, mostly multi-functional modules, in connection with the flow guide according to the invention, as well as the valve arrangement in the pump housing, according to the invention, makes it possible that the lubricant valve according to the invention can not only be cost-advantageously produced, in terms of production technology, but that because of the structure according to the invention, it can very well be pre-assembled, checked before installation, and can also be installed into the oil pump in simple, fast, and cost-advantageous manner.

In this connection, the lubricant valve according to the invention always works in robust, reliable, and non-failure-prone manner, even under very extreme conditions of use.

It is also in accordance with the invention that a friction-wear disk 37 with a passage bore 38 is disposed between the pressure spring 30 and the valve seat 7 disposed in the pump housing 1. The friction-wear disk 37 prevents the pressure spring 30 from working into the valve seat 7 of the pump housing 1.

The passage bore 38 disposed in the friction-wear disk 37 furthermore allows unhindered inflow and outflow of the lubricant oil into/out of the valve chamber 31 during displacement of the cold-start piston 14.

It is furthermore essential to the invention that a pressure equalization chamber 39 is disposed on the inside, in the piston crown 16 of the regulation piston 13, which chamber connects all the inflow bores 20 disposed in the piston crown 16 with one another, and can be closed off, over its full area, on the cold-start chamber side, by the closing cylinder lid 27 of the cold-start piston.

In this way, an optimal pressure buildup is guaranteed at the closing cylinder lid 27, and reliable valve play is guaranteed during a cold start.

It is advantageous that a drain bore 40 is disposed between the bearing point 2 and the valve spring chamber 31, so that the leakage fluid that exits from the bearing point 2 is conducted away in defined manner.

FIG. 3 now shows the lubricant valve according to the invention, shown in FIGS. 1 and 2, in its regulation function during a cold start.

During a cold start, the lubricant is still cold and therefore highly viscous. The pressure in the gallery amounts to 0 bar at first, when the engine is started.

The oil pump at first conveys the highly viscous oil and builds up a pump pressure, after several engine revolutions, that increases greatly because of the lack of flow velocity, and therefore would place severe stress on the components of the engine, which is still cold.

In the present exemplary embodiment, the modules of the lubricant valve according to the invention are now dimensioned in such a manner, i.e. the piston surfaces and the spring force of the pressure spring 30 are coordinated with one another in such a manner that at a pump pressure of 11 bar, the cold-start valve integrated into the lubricant valve according to the invention starts with its regulation function.

During a cold start, the gallery pressure still amounts to 0 bar, i.e. no pressure is applied in the control channel 9, as well as in the control chamber 34 connected with the control channel 9 by way of the control bore 36 (configured as a shutter), so that the working piston 18 remains in the end position (i.e. the spacer rod 19 lies against the closure screw 29).

In our exemplary embodiment, in the pressure channel 8 directly connected with the pressure kidney 5, and therefore also in the working chamber 33 of the lubricant valve according to the invention, the pressure has now increased to the pressure, for example to 11 bar, at which the cold-start valve integrated into the lubricant valve according to the invention is supposed to begin its regulation function.

Because the piston surfaces of the working piston 18 and of the piston crown 16 disposed on both sides of the piston rod 17, including the inflow bores 20 of the regulation piston 13 closed off by the closing cylinder lid 27 of the cold-start piston 14, agree with one another, the pump pressure of 11 bar applied in the working chamber 33 does not bring about any translational displacement of the working piston.

However, the pressure applied in the working chamber 33 builds up a pressure in the pressure equalization chamber 39, by way of the inflow bores 20, which pressure acts on the closing cylinder lid 27 of the cold-start piston 14, whereby, as has already been explained, the pressure spring 30 is dimensioned in such a manner that at a pressure of 11 bar, the cold-start piston 14 moves in the cold-start piston guide 15 of the cylinder wall 21 of the regulation piston 13, and in this connection "opens" the cold-start chamber 32, so that the highly viscous oil can flow off directly into the overflow channel 10, to the oil pan, out of the pressure channel 8, by way of the working chamber 33, the inflow bores 20, the pressure equalization chamber 39, the cold-start chamber 32, by way of the outflow bores 22 disposed in the cylinder wall 21 of the regulation piston 13.

The structure present in the solution according to the invention, which is advantageous in terms of flow technology, as well as the large flow cross-sections that are available, bring about the result that the solution according to the invention makes larger through-flow quantities possible even during a cold start, and in this connection is less sensitive to friction-wear particles and/or mold sand carried by the lubricant oil.

The warming engine brings about the result that the lubricant oil situated there warms up and that a gallery pressure now builds up.

This gallery pressure cancels out the force equilibrium that is present during a cold start, and leads to displacement of the working piston 18, which, as a regulation piston, now assumes normal regulation operation of the lubricant valve according to the invention when the engine is warm from operation.

FIG. 4 shows the lubricant valve shown in FIG. 1 in its regulation function when the engine has become warm from running, during ongoing operation.

In the present exemplary embodiment, a gallery pressure of 4 bar, for example, and a pump pressure of 6 bar, for example, was selected.

The gallery pressure applied in the control channel 9 brings about the result that lubricant oil enters into the control chamber 34 by way of the control bore 36, configured as a shutter, which cushions pressure surges and thereby decisively determines the "softness" of the regulation.

This lubricant oil from the gallery impacts the control chamber 34 and thereby the working piston 18 with the gallery pressure of 4 bar, for example, so that the working piston 18, at a pump pressure of 6 bar applied in the pressure channel 8, for example, and therefore also in the working chamber 33, displaces the regulation piston 13 along its piston guide 11, by means of the piston rod 17, to such an extent that this piston opens the overflow channel 10, and thus releases a bypass line for the "excess" volume stream directly from the pressure kidney 5, by way of the pressure channel 8, into the working chamber 33 and from there into the overflow channel 10, to the oil pan.

The regulation piston 13 connected with the working piston 18 by way of the piston rod therefore takes up its normal regulation operation after a gallery pressure is applied in the control channel 9. In other words, when the overflow channel 10 is opened, the pressure in the cold-start chamber 32 is reduced, and the closing cylinder lid 27 is pressed against the piston crown 16 of the regulation piston 13, by means of the pressure spring 30, sealing off the pressure equalization chamber 39.

When the engine shuts off, the gallery pressure in the control channel 9 and therefore also the pressure in the control chamber 34 drops back to 0 bar.

In this connection, the pressure spring 30 presses the free end of the spacer rod 19 into the end position, i.e. against the closure screw.

FIG. 5 shows the design of an oil pump for internal combustion engines shown in FIG. 1, with a lubricant valve according to the invention integrated into the pump housing, with the engine stopped, in a design modified as compared with FIG. 1. In this design of the lubricant valve according to the invention, the free end of the spacer rod 19 lies against the valve seat 7 of the pump housing 1 or against a friction-wear disk 37 disposed between spacer rod 19 and valve seat 7, which disk prevents the free end of the spacer rod 19 from working into the valve seat 7 of the pump housing 1, which housing consists of aluminum, for example.

On the opposite side, the pressure spring 30 lies against a closure screw.

However, this somewhat modified design of the lubricant valve according to the invention shown in FIG. 5 works/functions just like the design described in connection with FIGS. 1 to 4.

With the solution according to the invention, it has therefore been made possible to develop a lubricant valve for oil pumps of internal combustion engines that combines the functions of the cold-start valve and also those of the regulation valve in itself, with minimal construction space, while having such a structure that it is not sensitive to friction-wear particles and/or mold sand carried by the lubricant, while allowing high through-flow quantities, and furthermore has a cost-advantageous structure, in terms of production and assembly technology, and can be produced in cost-advantageous manner, and furthermore always works in robust, reliable, and non-failure-prone manner, even under extreme conditions of use.

REFERENCE SYMBOL LISTING

1 pump housing
2 bearing point
3 drive shaft
4 impeller set
5 pressure kidney
6 pressure connection channel
7 valve seat
8 pressure channel
9 control channel
10 overflow channel
11 piston guide
12 double piston
13 regulation piston
14 cold-start piston
15 cold-start piston guide
16 piston crown
17 piston rod
18 working piston
19 spacer rod
20 inflow bore
21 cylinder wall
22 outflow bore
23 guide cylinder
24 spring contact ring surface
25 closing cylinder
26 closing cylinder mantle
27 closing cylinder lid
28 spring contact
29 closure screw
30 pressure spring
31 valve spring chamber
32 cold-start chamber
33 working chamber
34 control chamber
35 damping bore
36 control bore
37 friction-wear disk
38 passage bore
39 pressure-equalization chamber
40 drain bore

The invention claimed is:

1. Lubricant valve for oil pumps of internal combustion engines, with a pump housing (1) with bearing points (2), an impeller set (4) of an oil pump driven by a drive shaft (3) mounted in the bearing points (2), with a pressure kidney (5) disposed in the pressure region of the pump housing (1), with a pressure connection channel (6) disposed on the pump housing (1), with a valve seat (7) disposed on the pump housing (1), a pressure channel (8) disposed between the valve seat (7) and the pressure connection channel (6), a control channel (9) disposed between the valve seat (7) and a gallery, and an overflow channel (10) disposed between the valve seat (7) and an oil pan, with a double piston (12) disposed in a piston guide (11) of the valve seat (7) in the pump housing (1), with an outer regulation piston (13), in which an inner piston guide for an inner piston is disposed, wherein a piston rod (17) with at least one working piston (18) is disposed on the regulation piston, beyond which the piston rod (17) projects in the form of a spacer rod (19), wherein inflow bores (20) are disposed in the piston crown (16) of the regulation piston (13), and outflow bores (22) are disposed in the region of the inner piston guide in the cylinder wall (21) of the regulation piston (13), wherein the inner piston guide disposed in the regulation piston (13) is configured as a cold-start piston guide (15), in which a cold-start piston (14) is disposed as an inner piston, wherein the piston rod (17) is disposed lying opposite the cold-start piston guide (15) on the piston crown (16) of the regulation piston (13), on which rod a working piston (18) is disposed, at a distance from the piston crown (16) of the regulation piston (13), and the inflow bores (20) disposed in the piston crown (16) are disposed adjacent to the piston rod (17), and the outflow bores (22) disposed in the cylinder wall (21) of the regulation piston (13) are disposed adjacent to the piston crown (16), and the cold-start piston (14) is configured as a multi-stage cylinder open on one side, which consists of an open guide cylinder (23) disposed to be displaceable in the cold-start piston guide (15) of the regulation piston (13), with a spring contact ring surface (24) and a closing cylinder (25) disposed adjacent to the spring contact ring surface (24), smaller in cylinder diameter as compared with the guide cylinder (23), with a closing cylinder mantle (26) and a closing cylinder lid (27), the closing cylinder mantle (26) disposed on the spring contact ring surface (24), and which closes off the inflow bores (20) when the closing cylinder lid (27) makes contact with the piston crown (16), and a biased pressure spring (30), disposed between a spring contact (28) on the pump housing (1) or on a closure screw disposed in the pump housing (1) and the spring contact ring surface (24) disposed in the guide cylinder (23) of the cold-start piston (14), wherein when the engine is stopped the spring presses the cold-start piston (14) into the regulation piston (13), sealing off the inflow bores (20), and in this connection displaces the regulation piston (13) with the piston rod (17), working piston (18) and spacer rod (19) disposed on it to such an extent until the free end of the spacer rod (19), opposite the spring contact (28), lies against the pump housing (1) or a closure screw (29) disposed in the pump housing (1), and in this connection divides up the working space disposed in the valve seat (7), into a valve spring chamber (31), a cold-start chamber (32) disposed between the regulation piston (13) and the cold-start piston (14), a working chamber (33) disposed between the piston crown (16) of the regulation piston (13) and the working piston (18), in the region of the piston rod (17), as well as a control chamber (34) disposed behind the working piston (18), in the region of the spacer rod.

2. Lubricant valve according to claim 1, wherein the valve spring chamber (31) is connected with the oil pan by way of a damping bore (35), the working chamber (33) is connected with the pressure kidney (5) by way of the pressure channel (8), and the control chamber (34) is connected with the control channel (9) by way of a control bore (36).

3. Lubricant valve according to claim 1, wherein the regulation piston (13) and the cold-start piston (14) are produced from the same material.

4. Lubricant valve according to claim 1, wherein the regulation piston (13) and the cold-start piston (14) are produced from steel.

5. Lubricant valve according to claim 1, wherein a friction-wear disk (37) with a passage bore (38) is disposed between the pressure spring (30) and the valve seat (7) disposed in the pump housing (1).

6. Lubricant valve according to claim 4, wherein a passage bore (38) is disposed in a friction-wear disk (37).

7. Lubricant valve according to claim 1, wherein a friction-wear disk (37) is disposed between the free end of the spacer rod (19) and the valve seat (7) disposed in the pump housing (1).

8. Lubricant valve according to claim 1, wherein a pressure equalization chamber (39) is disposed on the inside of the piston crown (16) of the regulation piston (13), which chamber connects all the inflow bores (20) disposed in the piston crown (16) with one another, and can be closed off, over its full area, on the cold-start chamber side, by the closing cylinder lid.

9. Lubricant valve according to claim 1, wherein drain bores (40) are disposed between the bearing points (2) and the valve spring chamber (31).

* * * * *